United States Patent [19]

Nakajima

[11] 4,258,290

[45] Mar. 24, 1981

[54] OPERATION INDICATOR FOR AUTO-STROBO UNIT

[75] Inventor: Yukio Nakajima, Hachioji, Japan

[73] Assignee: Olympus Optical Co., Ltd., Tokyo, Japan

[21] Appl. No.: 37,653

[22] Filed: May 10, 1979

[30] Foreign Application Priority Data

Jul. 28, 1978 [JP] Japan ..... 53-10370[U]

[51] Int. Cl.[3] ..... H05B 41/32

[52] U.S. Cl. ..... 315/135; 315/136; 315/151; 315/241 P; 354/128

[58] Field of Search ..... 315/134, 135, 151, 241 P, 315/136; 354/33, 128, 145

[56] References Cited

U.S. PATENT DOCUMENTS

| | | | |
|---|---|---|---|
| 3,993,928 | 11/1976 | Wilwerding | 315/241 P |
| 3,999,193 | 12/1976 | Hasegawa | 354/33 |
| 4,099,100 | 7/1978 | Takahata | 315/134 X |

*Primary Examiner*—Eugene R. La Roche

*Attorney, Agent, or Firm*—Weinstein & Sutton

[57] ABSTRACT

An operation indicator for auto-strobo unit which includes a single light emitting element capable of indicating the completion of a charging operation or a flashlight illumination of the auto-strobo unit, comprises a bypass circuit which any current flow associated with the indication of the completion of a charging operation is bypassed whenever a current flow associated with the indication of the completion of a flashlight illumination is produced, thus allowing the indication of the completion of a flashlight illumination to predominate over the indication of the completion of a charging operation.

6 Claims, 3 Drawing Figures

OPERATION INDICATOR FOR AUTO-STROBO UNIT

BACKGROUND OF THE INVENTION

The invention relates to an operation indicator for auto-strobo unit, and more particularly, to such operation indicator in which the completion of a flashlight illumination and a charging operation of an auto-strobo unit is indicated by a single light emitting element.

The electrical circuit of one exemplary auto-strobo unit is shown in FIG. 1. Referring to this Figure, a battery, representing a power source E, is connected in series with a power switch S of the unit across the input of a voltage step-up circuit 1, which is in turn connected with a flashlight illumination circuit.

The flashlight illumination circuit includes rectifier diode D1 having its anode connected with the output of the step-up circuit and its cathode connected with one terminal of main capacitor C1, the other terminal of which is connected with the other output terminal of the step-up circuit, which represents one of buses, E1. The junction between diode D1 and capacitor C1 is connected with the other bus E2. The flashlight illumination circuit also includes a series combination of a flash discharge tube F and a main switching element D4 connected across these buses, with a trigger circuit 2 connected with a trigger electrode $F_T$ of the discharge tube F. The junction between the tube F and switching element D4 is connected with a control circuit 3 through capacitor C4. A charging complete indicator includes a series combination of resistor R1 and light emitting element B1, formed by a neon lamp, which has its one end connected with bus E2. Finally, the flashlight illumination circuit includes a flashlight complete indicator circuit which comprises resistor R2, capacitors C2, C3, diode D2 and light emitting element B2. It will be noted that a Zener diode D2 has its cathode connected with one end of both light emitting elements B1, B2 and its anode connected with bus E1.

A series combination of diode D3 and capacitor C3 is connected in shunt with the switching element D4, and the capacitor C3 is shunted by a series combination of resistor R2 and capacitor C2. The light emitting element B2 which comprises a neon tube is connected across the junction between resistor R2 and capacitor C2 and the cathode of Zener diode D2. It is also to be noted that the cathode of Zener diode D2 is also connected with a separate light emitting element P, located within the finder of camera 4 on which the auto-strobo unit is mounted. The other end of the element P is returned to bus E1. The trigger circuit 2 is also connected with bus E1 through synchro contacts X of the camera.

In operation, as the power switch S is closed, the circuit 1 steps up the voltage, which is rectified by diode D1 to feed the flashlight illumination circuit. Light emitting element B1 is illuminated when main capacitor C1 is completely charged, thus indicating that a charging operation of the auto-strobo unit has been completed in preparation to the initiation of a flashlight illumination. Simultaneously, it feeds the separate light emitting element P to cause an illumination thereof, thus providing a visual display of the completion of a charging operation within the finder of the camera 4.

When the synchro contacts X of the camera 4 are closed in synchronized relationship with a shutter release operation, the trigger circuit 2 is effective to apply a trigger voltage to the trigger electrode $F_T$ of the flash discharge tube F and to the gate of the main switching element D4, thus rendering the both conductive. The control circuit 3 includes a photometric circuit having a light receiving element therein and is effective, when it is determined that an optimum exposure has been given to an object being photographed which is illuminated by the flashlight from the discharge tube F, to produce a control signal which is applied to the anode of main switching element D4 to turn it off, thus interrupting the flashlight illumination from the tube F. When the switching element D4 is turned off, the current flow from the tube F is bypassed through diode D3 to charge capacitor C3, which in turn charges capacitor C2 through resistor R2. Element B2 blinks in response to the discharge of capacitor C2, thus indicating that a flashlight illumination has been properly given. Specifically, a blinking operation of element B2 occurs as a result of a reduction in the internal resistance thereof once it has commenced discharge to initiate the illumination whereby it is extinguished. However, as the terminal voltage across capacitor C2 increases to a level which is sufficient to cause a discharge of the element, the latter re-initiates its discharge to produce illumination. Such operation is repeated to provide a blinking operation. The blinking current flow is also fed to the element P to cause a blinking operation thereof within the finder of the camera.

It will be noted from the foregoing description that the continuous current flow through the element B1 and the blinking current through the element B2 are simultaneously fed to the separate element P, which is thus energized by a superimposed current flow. Thus, the illumination provided by the element P will be a continuous illumination level superimposed with a pulsating illumination of a reduced level. It will be understood that the pulsating illumination of a reduced level involves difficulty in recognizing it, giving rise to a disadvantage that the completion of a flashlight illumination may not be noticed or recognized.

FIG. 2 shows another exemplary electrical circuit of an operation indicator for auto-strobo unit. The principal difference of this circuit arrangement as compared with the previous circuit shown in FIG. 1 is that the continuous current flow or the blinking current flow from the element B1 or B2 is not directly supplied to the separate element P, but is used to turn drive transistor $Q_1$ on and off, which is directly fed from the voltage step-up circuit 1 to energize the separate element P for illumination. This arrangement can be used where the continuous current flow or the blinking current through the element B1 or B2 is insufficient to cause an illumination of the separate element P when it is supplied alone. The circuit arrangement is generally similar to that shown in FIG. 1 except that Zener diode D2 is eliminated, with the junction between elements B1 and B2 being connected with the base of drive transistor $Q_1$ of NPN type having its collector connected with the separate element P and its emitter connected with bus E3, which is fed from the voltage step-up circuit 1.

In operation, the elements B1 and B2 are illuminated either continuously or intermittently in the same manner as mentioned above in connection with FIG. 1. Such current flow is supplied to the base of transistor $Q_1$ to turn it on, whereby the element P is energized for illumination by a closed path including bus E1, element P and the collector emitter path of transistor $Q_1$ and returning to the step-up circuit 1. When the continuous current flow from element B1 and the blinking current flow from element B2 are simultaneously supplied to the base of the transistor $Q_1$, the effect of the blinking current upon the turning on and off of transistor $Q_1$ is blanked by that of the continuous current flow, so that the separate element P will be illuminated in the same manner as it is illuminated to indicate the completion of the charging operation. Consequently, the arrangement shown has a disadvantage that it is impossible to confirm the completion of a flashlight illumination within the finder of camera 4 so long as the indication of the completion of a charging operation continues.

SUMMARY OF THE INVENTION

It is an object of the invention to eliminate above disadvantage of the prior art, by providing an operation indicator for auto-strobo unit in which whenever a signal is produced which indicates the completion of a flashlight illumination, a signal which indicates the completion of a charging operation is bypassed to facilitate the recognition of an indication of the completion of a flashlight illumination.

In accordance with the invention, the completion of a flashlight illumination can be clearly recognized if one of the light emitting elements continues to provide an indication of the completion of a charging operation, by the provision of a bypass circuit which bypasses the latter current flow. In this manner, there is provided an operation indicator for auto-strobo unit which avoids the difficulty of recognition or the likelihood of a wrong recognition.

DESCRIPTION OF PREFERRED EMBODIMENTS

Figure 1:
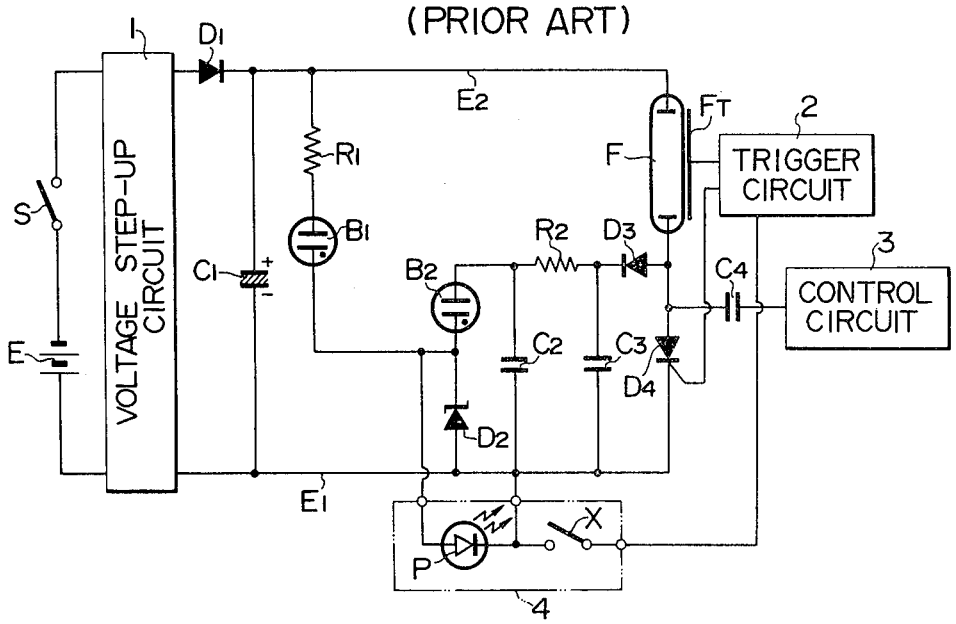
FIG. 1 (PRIOR ART)
FIG. 1 is a circuit diagram of one exemplary electrical circuit of a conventional operation indicator for auto-strobo unit.
Figure 3:
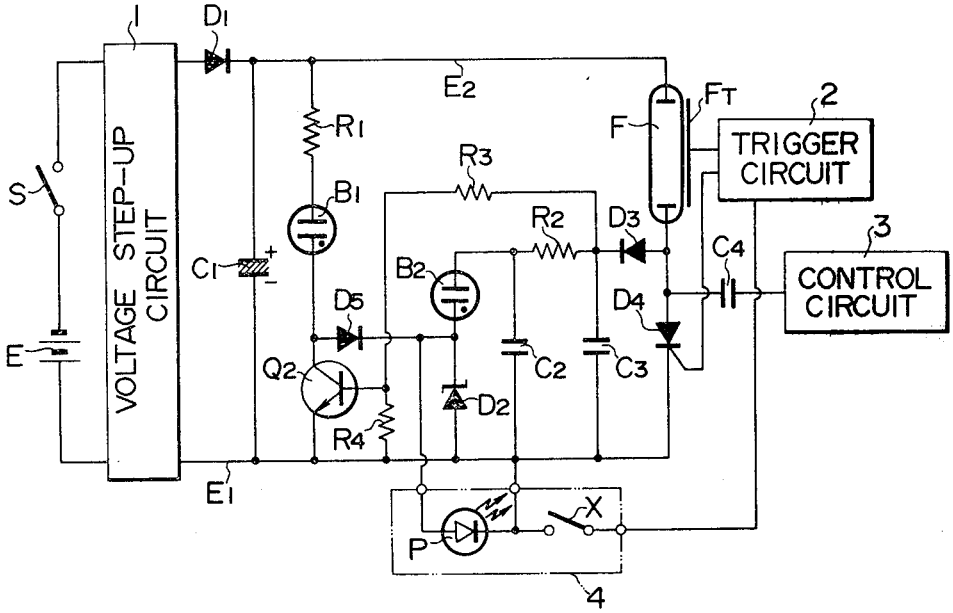
FIG. 3 is a circuit diagram of an operation indicator for auto-strobo unit which is constructed in accordance with one embodiment of the invention.

Referring to FIG. 3, there is shown an electrical circuit of an operation indicator for auto-strobo unit which is constructed in accordance with one embodiment of the invention. As shown, the circuit arrangement is similar to that shown in FIG. 1 except that a bypass circuit is added which comprises transistor $Q_2$, diode D5 and resistors R3, R4. Therefore, similar parts are designated by like reference characters without repeating their description. The bypass circuit includes diode D5 which has its anode connected with one terminal of element B1 and its cathode connected with the junction between element B2 and Zener diode D2. A voltage diver comprising series resistors R3, R4 is connected between the junction between resistor R2 and diode D3 and bus E1, with the junction between both resistors being connected with the base of bypass transistor $Q_2$ of NPN type. Transistor $Q_2$ has its collector connected with the junction between element B1 and diode D5 and its emitter connected with bus E1.

In operation, element B1 is illuminated upon completion of the charging of main capacitor C1 as before. Its current flow is fed through diode D5 to the separate light emitting element P located within the finder, thus illuminating it. Subsequently, when a proper exposure has been given by the flash discharge tube F in response to a shutter release operation, the control circuit 3 produces a signal which turns switching element D4 off, whereby the current flow from the tube F is bypassed through capacitor C3. It in turn charges capacitor C2, which causes a blinking operation of element B2. The blinking current is also fed to the element P to cause a similar blinking operation. At the same time, the voltage across capacitor C3 is divided by the voltage divider R3, R4 to be applied to the base of transistor $Q_2$, which is then turned on to bypass any continuous current flow through the element B1 to bus E1. Consequently, if the element B1 continues to be illuminated to indicate that main capacitor C1 is fully charged at the time the flashlight illumination has been terminated, the only current flow through the separate element P, located within the finder, is the blinking current from the element B2, without superimposition on the continuous current flow from the element B1, whereby a blinking operation of the element P provides a clear indication of the completion of a flashlight illumination within the finder of camera 4. It is possible to provide a selected time period during which the indication of the completion of a flashlight illumination predominates over the indication of the completion of a charging operation, by choosing a suitable value for resistor R4. In this manner, it can be assured that the indication of the completion of a flashlight illumination predominates only during a sufficient time interval to enable a clear recognition thereof, without any adverse influence upon the subsequent indication of the fully charged condition of the main capacitor in preparation to a next photographing operation.

Figure 2:
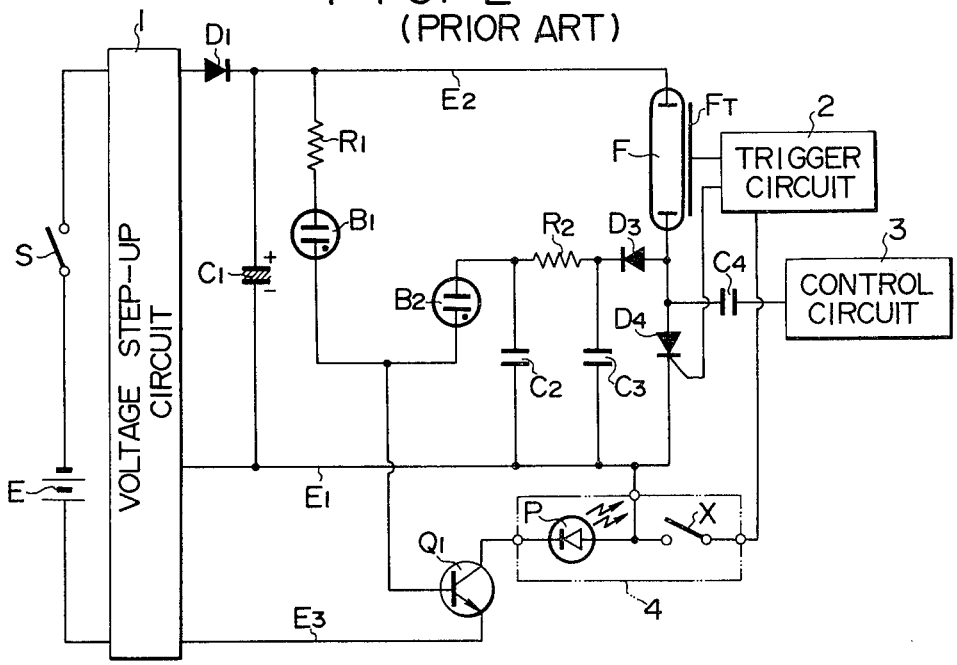
FIG. 2 (PRIOR ART)
FIG. 2 is a circuit diagram showing another example of such electrical circuit.
Figure 4:
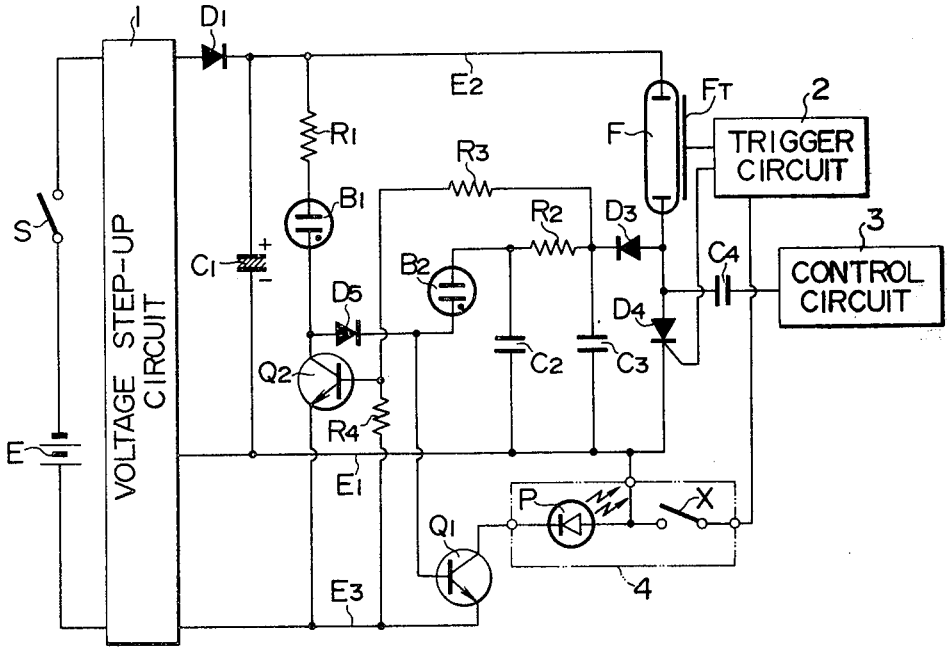
FIG. 4 is a circuit diagram of another embodiment of the invention.

FIG. 4 shows an electrical circuit according to another embodiment of the invention. The circuit arrangement shown corresponds to that shown in FIG. 2, with the bypass circuit added in accordance with the invention. Consequently, similar parts to those shown in FIG. 2 are designated by like reference characters without repeating their description.

The bypass circuit again comprises diode D5 connected between elements B1 and B2 with a voltage divider comprising resistors R3, R4 being connected between the junction between resistor R2 and diode D3 and bus E3. The junction between resistors R3, R4 is connected with the base of bypass transistor $Q_2$ of NPN type which has its collector connected with the anode of diode D5 and its emitter connected with bus E3.

Element E1 is illuminated upon completion of a charging operation, and its current flow is fed to the base to drive transistor $Q_1$, which is therefore turned on, whereby separate light emitting element P is energized for illumination through a path including bus E1, element P and the collector-emitter path of transistor $Q_1$ and returning to the voltage step-up circuit 1. When a proper amount of exposure has been given by the flashlight illumination from the tube F in response to a shutter release operation, the control circuit 3 produces a signal which turns switching element D4 off, whereby the current flow from the tube F is bypassed to charge capacitor C3. This capacitor in turn charges capacitor C2, which causes a blinking operation of element B2. The blinking current is also fed to the base of transistor $Q_1$ to turn it on, whereby the element P is energized from the circuit 1 for illumination. At the same time, the voltage across capacitor C3 is divided by the voltage divider R3, R4 to be applied to the base of transistor $Q_2$.

This transistor is turned on to bypass any current flow through the element B1 to bus E3. As a consequence, if the element B1 continues to illuminate to indicate the fully charged condition of the main capacitor at the time the completion of a flashlight illumination is to be indicated, the only current supplied to the base of transistor $Q_1$ is the blinking current from the element B2, so that the element P is capable of blinking to provide a clear indication of the completion of a flashlight illumination within the finder of camera 4.

As in the embodiment shown in FIG. 3, the value of resistor R4 can be suitably chosen to provide a short time interval during which the indication of the completion of a flashlight illumination predominates over the indication of the completion of a charging operation, which may be required to effect a next photographing operation.

What is claimed is:

1. An operation indicator for an auto-strobo unit comprising a flash discharge tube, a main capacitor for supplying power to said flash discharge tube, a charging complete indicator circuit for detecting and indicating that the voltage across the main capacitor has reached a given level, a control circuit responsive to a proper amount of exposure for producing an illumination interrupt signal, a flashlight illumination complete indicator circuit responsive to said interrupt signal, a single light emitting element responsive to respective signals from the individual indicator circuits for indicating the completion of a charging operation and the completion of a flashlight illumination, and a bypass circuit which is responsive to the interrupt signal from the control circuit for disabling any current flow from the charging complete indicator circuit to the light emitting element, thus allowing an indication of the completion of a flashlight illumination to predominate over the indication of the completion of a charging operation.

2. An operation indicator according to claim 1 in which the charging complete indicator circuit comprises a second light emitting element; and said bypass circuit comprises a bypass transistor coupled thereto, and a resistive voltage divider for receiving an output voltage of the flashlight illumination complete indicator circuit and applying a divided version thereof to said bypass transistor, thereby turning the latter on.

3. An operation indicator according to claim 2 in which a voltage division ratio of the voltage divider establishes a time interval during which the bypass transistor is turned on.

4. An operation indicator according to claim 1 in which a current flow from the charging complete indicator circuit is supplied to said single light emitting element whenever the bypass circuit is inoperative.

5. An operation indicator as claimed in claim 4, further comprising a drive transistor coupled between said single light emitting element and said charging complete circuit.

6. An auto-strobo unit comprising a flash discharge tube, a main capacitor for being charged and for supplying power to said flash discharge tube, single means for indicating both conditions that charging of said main capacitor is complete and for indicating that flashlight illumination is complete, and means for preventing said single indicating means from indicating that charging is complete upon receiving a signal that flashlight illumination is complete.

* * * * *